United States Patent [19]

Kerr et al.

[11] Patent Number: 5,074,993

[45] Date of Patent: Dec. 24, 1991

[54] FLOTATION PROCESS

[75] Inventors: Andrew N. Kerr, Sudbury; Dietrich Liechti, Naughton; Maria A. Marticorena, Lively; Daniel A. Pelland, Azilda, all of Canada

[73] Assignee: Inco Limited, Toronto, Canada

[21] Appl. No.: 683,623

[22] Filed: Feb. 22, 1991

Related U.S. Application Data

[63] Continuation of Ser. No. 403,675, Sep. 6, 1989, abandoned.

[51] Int. Cl.[5] ..... B03D 1/01; B03D 1/02

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 1,364,304 | 1/1921 | Perkins | 209/166 |
| 1,364,305 | 1/1921 | Perkins | 209/166 |
| 1,364,306 | 1/1921 | Perkins | 209/166 |
| 1,364,307 | 1/1921 | Perkins | 209/166 |
| 1,610,217 | 12/1926 | Elley | 209/166 |
| 4,078,993 | 3/1978 | Griffith | 209/167 |
| 4,139,455 | 2/1979 | Griffith | 209/167 |
| 4,394,257 | 7/1983 | Wang | 209/166 |
| 4,676,890 | 6/1987 | Klinpel | 209/166 |
| 4,684,459 | 8/1987 | Klinpel | 209/166 |
| 4,744,893 | 5/1988 | Rothenberg | 209/167 |
| 4,797,202 | 1/1989 | Klimpel | 209/166 |
| 4,806,234 | 2/1989 | Bresson | 209/167 |
| 4,822,483 | 4/1989 | Klimpel | 209/166 |
| 4,866,150 | 9/1989 | Lipp | 209/167 |

FOREIGN PATENT DOCUMENTS

| | | | |
|---|---|---|---|
| 771181 | 11/1967 | Canada | 209/166 |
| 771182 | 11/1967 | Canada | 209/166 |
| 753469 | 7/1978 | U.S.S.R. | 209/166 |
| 957724 | 5/1964 | United Kingdom | 209/166 |

*Primary Examiner*—Stanley S. Silverman
*Assistant Examiner*—Thomas M. Lithgow
*Attorney, Agent, or Firm*—Francis J. Mulligan, Jr.; Edward A. Steen

[57] ABSTRACT

A method of flotation of sulfides wherein pyrrhotite is depressed by use of a water-soluble polyamine while non-ferrous metal-containing sulfide or sulfidized minerals are floated selectively.

8 Claims, No Drawings

FLOTATION PROCESS

This is a continuation of application Ser. No. 403,675, filed on Sept. 6, 1989, now abandoned.

The present invention is concerned with flotation and, more particularly, with selective flotation of sulfidic minerals.

BACKGROUND OF THE INVENTION

Ores and various concentrates of ores which contain valuable metals such as nickel, copper, zinc, lead, etc. as simple or complex sulfides together with small amounts of the precious metals gold and silver and platinum group metals present in various forms including distinct sulfidic, selenic and telluric species are almost universally concentrated by froth flotation using xanthates or other sulfur-containing collectors. The various schemes of froth flotation employed are generally quite complex having been developed in order to maximize grade and recovery of the valuable metals present and to maximize discarding of rock and mineral species of little commercial value. In addition to strictly sulfide minerals, certain oxide or carbonate species of metals such as copper can also be floated. In floating these oxide or carbonate minerals such as cuprite, malachite, azurite, chrysocolla, etc., ground mineral surfaces can be sulfided by reagents such as sodium sulfide carried in the liquid continuum of the flotation pulp or can be rendered amenable to flotation by overdosing with a collector such as a xanthate. For purposes of this specification and claims the term "flotable non-ferrous metal-containing mineral" is intended to include, but not be limited to, the mineral species chalcopyrite, chalcocite, pentlandite, niccolite, millerite, stannite, cuprite, malachite, galena, stibnite, heazlewoodite, argentite, covellite, sperrylite, cinnabar, cubanite, cobaltite, skutterudite and smaltite.

After concentration, sulfidic minerals are most often subjected to pyrometallurgical oxidation, a bi-product of which is sulfur dioxide. Good practice, as well as governmental orders, requires that sulfur dioxide released to the atmosphere be minimized. Sources of sulfur often present in ore bodies are the minerals pyrrhotite, pyrite and marcasite. Pyrrhotite has a composition roughly $Fe_8S_9$ and is symbolized hereinafter as Px. In many ores Px carries with it very little material of economic value but does contain sulfur which contributes to the sulfur dioxide burden. Px can be either strongly ferromagnetic, in which case it can be separated by magnetic separation, or paramagnetic in which case magnetic separation is not practical. In the past, procedures such as the Inco-developed cyanide process, Canadian Patent No. 1,062,819 and the $SO_2$/air process (patent pending) have been developed to maximize rejection of Px during flotation. These processes in general have been successful but often require extensive conditioning of mineral pulps to be reasonably operable.

DISCOVERY

Our discovery involves the use of a class of reagents which permits selective flotation of a floatable non-ferrous metal-containing mineral while depressing the flotation of Px, but at the same time permitting excellent grade and recovery of non-ferrous metal values.

DESCRIPTION OF INVENTION

In its broadest aspect, the present invention contemplates a process or method of flotation of at least one non-ferrous metal-containing mineral (as defined hereinbefore) in the presence of Px which comprises treating a ground mineral mixture as a pulp in an aqueous alkaline continuum with a polyamine preponderantly non-heterocyclic in nature and having limited or nil collecting capacity. The polyamine is used prior to, during or after grinding in an amount of at least about 0.05 gram per kilogram. (For purposes of this specification and claims the kilogram weight refers to the dry weight of solids in a flotation pulp and, more particularly, in the range of about 0.10 to about 0.50 g/Kg.) Following polyamine addition, the pulp may be conditioned aerobically or anaerobically for periods ranging from 0 to 30 minutes. The pulp is then floated so that, in the presence of a collector, a frother and a gas phase distributed throughout the pulp, the non-ferrous metal-containing mineral floats selectively as compared to the Px.

More specifically, the present invention has been tested and found operable with ore pulps containing Px and the non-ferrous metals copper and nickel specifically in the form of chalcopyrite (Cp) and pentlandite (Pn) as well as sperrylite and other associated mineral sulfide, selenide, arsenide and telluride species. In flotation, the aqueous phase of the pulp has a pH preferably in the range of about 8 to 11 and, perhaps, ideally at about 9.2.

The present invention has also been tested and found operable with ore pulps containing Px, Cp and Pn and in which the ore has undergone a natural or induced process of oxidative conditioning or leaching prior to or during flotation, such that the ore has been exposed to oxygen as well as to oxidation products of the sulfide ion such as sulfite or thiosulfate and to cations of copper, nickel, iron or other metals to such an extent and in such a manner as to detrimentally affect the selective separation of Cp and Pn from Px. Ore having undergone such a process is hereinafter referred to as "oxidized ore". It is within the contemplation of the present invention to treat an oxidized ore in which at least one non-ferrous metal-containing mineral is to be separated from an iron-bearing sulfide other than Px, such as pyrite or marcasite.

In carrying out the method or process of the present invention the generally accepted techniques of mineral flotation are employed. Thus, mineral species are in the form of ground particles having an average size in the range of about 62 to 210 micrometers. This size range avoids excessively fine slime producing material and excessively coarse material which is not amenable to selective flotation. For most practical purposes xanthogenates (xanthates) are used as collectors, such materials being very efficient and economical. The present invention has been tested and found operative when the principle sulfide mineral collector is a xanthate, a dithiophosphate or a thionocarbamate. Phosphinic acid, mercaptobenzothiazole, dixanthogen formate and the like may also be employed. The collectors are added in the usual amounts, e.g. of the order of 0.04 gram of potassium amyl xanthate (KAX) per kilogram. Frothers such as alcohols, methyl isobutyl carbinol, pine oil and proprietary frothers such as those of the DOWFROTH TM group can be used and the gas phase is normally air bubbles distributed in the pulp by a commercial flotation machine although nitrogen or nitrogen enriched air can be used as the gas phase.

The essence of the present invention as specifically tested is the use of a polyamine to depress Px while allowing Cp and Pn and other mineral sulfide, selenide and telluride species containing valuable non-ferrous base and precious metals to float. In practice up to the present time it has been found that polyamines containing at least two amine moieties, at least two of which are separated by two or three carbon atoms are operable. The present invention may most advantageously be represented by ethylenediamine, diethylenetriamine and triethylenetetramine. Other related structures which have demonstrated selective depressant properties include tetraethylenepentamine, pentaethylenehexamine, 2-[(2-aminoethyl)amino]ethanol, N-methyl ethylenediamine, 1,2 diamino 2 methylpropane, and Tris-(2-aminoethyl) amide. Structures based upon propylene diamine show weak to absent depressant properties and are not very useful for the purpose of this invention.

Unsuccessful structures include primary, secondary and tertiary alkyl monamines and alkyl polyamines wherein the alkyl group separating the amines has chain length four or larger. Also unsuitable are molecules with R or R' unsubstituted moieties of carbon chain length two or greater. These possess collecting properties. Hydrophilic moieties larger than those containing 2 carbon atoms (e.g. propanolyl) are also detrimental to depressant performance.

The depressant action of the above structures appears to be related to the ability to form metal chelates. Thus, the most favorable structure is that which allows two nitrogen atoms to coordinate around a metal ligand in a five-membered ring (i.e., an NCCN structure). Based upon this model a monamine will not be effective and substituted amines will not be as effective (due to steric hinderance) as unsubstituted amine groups. Nitrogen-oxygen chelating compounds (e.g. ethanolamine, NCCO) appear to be ineffective. The NCCN depressants as described above are effective only when the amino group is predominantly non-protonated (i.e. at a pH of approximately 8 to 9 or higher, depending upon the basicity of the amine being applied). Experimental confirmation of this model has been obtained.

One interesting compound known for its chelating properties is ethylenediamine tetraacetic acid. This compound is slow to chelate in the NCCN configuration due to steric hindrance and tends, instead, to form six-membered OCNCO rings around metal ligands. Consequently, this compound is ineffective as a selective pyrrhotite depressant as defined herein. The NCCN structure defined above stands apart from the polymeric amine depressants described by Griffith (e.g. U.S. Pat. Nos. 4,078,993 and 4,139,455) in that amine depressant structures for pyrrhotite in the abovementioned patents depend upon the presence of tertiary amines with no required geometrical relationship between amine moieties whereas the current invention relies upon a specific configuration of two or more amine groups (which are most advantageously primary, but which may also be secondary or tertiary) such that ethylene diamine chelate rings may form.

It is within the contemplation of this invention to use amines and saturated or unsaturated cyclic structures which could also confer the geometry required for chelation in an NCCN or NXXN configuration. Among these are n, n+1 amino substitutions of aromatic and cyclic compounds (e.g. 1,2 diaminobenzene) or aminomethyl substitution on nitrogen-containing aromatic rings such as in 2 aminomethyl piperidine in which the surfactant properties are conferred by coordination of a ligand between two nitrogen atoms in a five-membered ring, as well as aliphatic amines capable of forming an unsaturated five-membered ring (e.g. HN=CH—CH-2—NH2). Nitriles have an unfavorable geometry due to the displacement of the unshared electron pair on the triple-bonded nitrogen.

In order to give those skilled in the art a better appreciation of the advantages of the invention the following examples are given.

EXAMPLE I

A Sudbury, Ontario, Canada nickel-copper ore suitable for rod mill feed was subjected to laboratory tests. This ore consists primarily of a matrix of silicates and pyrrhotite containing the ore minerals pentlandite and chalcopyrite. 1250 grams of ore in a pulp of 65% solids with the aqueous liquid of the pulp (or slurry) having an initial pH of about 9.2 were ground in a laboratory rod mill for 8.8 minutes per kilogram of solid. The ground pulp was floated in a Denver TM Dl laboratory flotation machine using air as the gaseous phase with about 0.04 g/Kg of KAX as collector (0.01 g/Kg being added to the grind and 0.03 g/Kg being added to the flotation cell) and about 0.025 g/Kg of DOWFROTH TM 1263 as frother. Flotation was carried out for a total of 19 minutes with samples of concentrate being collected for the periods 0–3, 3–6, 6–10, 10–14 and 14–19 minutes. The pH of the flotation feed was in the range of 9.0 to 9.5. For comparative purposes illustrative of standard practice without the use of amine the data in Table 1 is given. In each of the tables in this specification the amount of pyrrhotite is calculated according to Inco standard practice by subtracting from the total sulfur assay the amount of sulfur which is contained in chalcopyrite and pentlandite:

$$Px=[S-Cu^{*}\ 1.0145-Ni^{*}\ 0.9652]^{*}\ 2.549$$

Likewise, pentlandite is calculated according to standard Inco practice by subtracting from the nickel assay the amount of nickel normally present as solid solution in pyrrhotite:

$$Pn=(Ni-0.008^{*}\ Px)^{*}\ 2.7778$$

TABLE 1

| | | Sudbury Ore, Standard Test | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.85 | 0.83 | 7.98 | 1.93 | 16.12 | 100.00 | 100.00 | 100.00 | 100.00 |
| Cumulative Concentrates | | | | | | | | | | |
| 0 min | 3.4 | 7.50 | 10.05 | 32.90 | 27.03 | 39.74 | 30.10 | 41.50 | 47.60 | 8.40 |
| 3 min | 8.3 | 7.03 | 6.49 | 33.43 | 16.90 | 51.08 | 68.90 | 65.60 | 72.80 | 26.40 |
| 6 min | 13.5 | 5.34 | 4.68 | 33.11 | 11.67 | 59.09 | 84.90 | 76.60 | 81.60 | 49.60 |

TABLE 1-continued

| | Sudbury Ore, Standard Test | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| 10 min | 17.6 | 4.33 | 3.87 | 32.72 | 9.36 | 62.67 | 89.60 | 82.60 | 85.20 | 68.50 |
| 14 min | 19.8 | 3.94 | 3.57 | 32.42 | 8.49 | 63.68 | 91.50 | 85.40 | 86.80 | 78.10 |
| Tails | 80.2 | 0.09 | 0.15 | 1.96 | 0.32 | 4.39 | 8.50 | 14.60 | 13.20 | 21.90 |

The data set forth in Tables 2, 3 and 4 represent the practice of the present invention in which about 0.23 g/Kg (of ore solids) diethylene triamine, 0.23 g/Kg ethylene diamine, and 0.46 g/Kg 2-[(2-aminoethyl-)amino] ethanol, respectively, are added during the grinding stage prior to flotation. A comparison of Tables 2, 3 and 4 with Table 1 shows that the addition of diethylene triamine, ethylene diamine or 2-[(2-aminoethyl)amino] ethanol to the grind results in less Px reporting to the concentrate at any given recovery of Pn. None of the depressants show deleterious effects upon Cp or Pn recoveries.

TABLE 2

| | Sudbury Ore, 0.23 g/Kg Diethylene Triamine | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.00 | 0.91 | 0.85 | 8.17 | 2.00 | 16.37 | 100.00 | 100.00 | 100.00 | 100.00 |
| Cumulative Concentrates | | | | | | | | | | |
| 0 min | 3.0 | 11.00 | 13.70 | 34.30 | 37.49 | 25.28 | 36.20 | 48.30 | 56.20 | 4.60 |
| 3 min | 5.4 | 11.98 | 10.13 | 33.15 | 27.49 | 28.60 | 70.80 | 64.20 | 74.10 | 9.40 |
| 6 min | 7.5 | 10.42 | 8.06 | 32.37 | 21.61 | 35.73 | 85.70 | 71.10 | 81.10 | 16.40 |
| 10 min | 10.1 | 8.24 | 6.39 | 31.82 | 16.78 | 44.08 | 91.00 | 75.80 | 84.60 | 27.20 |
| 14 min | 11.8 | 7.13 | 5.64 | 31.36 | 14.60 | 47.64 | 92.30 | 78.30 | 86.20 | 34.50 |
| Tails | 88.2 | 0.08 | 0.21 | 5.06 | 0.31 | 12.17 | 7.70 | 21.70 | 13.80 | 65.50 |

TABLE 3

| | Sudbury Ore, 0.23 g/Kg Ethylene Diamine | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.85 | 0.87 | 7.99 | 2.06 | 16.05 | 100.00 | 100.00 | 100.00 | 100.00 |
| Cumulative Concentrates | | | | | | | | | | |
| 0 min | 2.9 | 6.99 | 15.00 | 33.20 | 41.01 | 29.65 | 23.90 | 50.10 | 57.80 | 5.40 |
| 3 min | 4.9 | 9.37 | 11.24 | 32.54 | 30.53 | 31.07 | 54.30 | 63.60 | 73.00 | 9.50 |
| 6 min | 6.7 | 9.92 | 8.96 | 32.04 | 24.13 | 33.98 | 78.90 | 69.60 | 79.20 | 14.30 |
| 10 min | 9.1 | 8.34 | 7.15 | 31.47 | 18.96 | 41.04 | 89.30 | 74.80 | 83.80 | 23.20 |
| 14 min | 10.7 | 7.29 | 6.30 | 30.64 | 16.53 | 43.76 | 91.60 | 77.40 | 85.70 | 29.10 |
| Tails | 89.3 | 0.08 | 0.22 | 5.29 | 0.33 | 12.74 | 8.40 | 22.60 | 14.30 | 70.90 |

TABLE 4

| | Sudbury Ore, 0.46 g/Kg 2-[(2-aminoethyl)amino] ethanol | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.87 | 0.81 | 8.11 | 1.88 | 16.43 | 100.00 | 100.00 | 100.00 | 100.00 |
| Cumulative Concentrates | | | | | | | | | | |
| 0 min | 4.5 | 9.23 | 10.20 | 33.30 | 27.54 | 35.92 | 47.20 | 56.50 | 65.60 | 9.80 |
| 3 min | 6.9 | 9.50 | 7.76 | 32.59 | 20.69 | 39.41 | 75.20 | 66.50 | 76.20 | 16.60 |
| 6 min | 9.0 | 8.41 | 6.52 | 31.36 | 17.17 | 42.17 | 86.20 | 72.30 | 81.90 | 23.00 |
| 10 min | 11.7 | 6.78 | 5.36 | 30.75 | 13.84 | 47.65 | 90.40 | 77.40 | 85.90 | 33.80 |
| 14 min | 14.2 | 5.67 | 4.60 | 30.43 | 11.63 | 51.59 | 92.10 | 80.90 | 87.90 | 44.50 |
| Tails | 85.8 | 0.08 | 0.18 | 4.42 | 0.26 | 10.62 | 7.90 | 19.10 | 12.10 | 55.50 |

EXAMPLE II

Samples of Inco pyrrhotite rejection feed were subjected to treatment with diethylene triamine to illustrate the beneficial effects of these amine depressants on oxidized feed material. Pyrrhotite rejection feed is derived from various stages of magnetic separation, flotation and thickening of Sudbury nickel-copper ore and is typically considered to be an oxidized stream showing poor selectivity when subjected to flotation.

Samples of Px rejection feed were allowed to settle, whereupon water was decanted to produce a slurry of about 55% solids for regrinding. The slurry was ground for 5 minutes per kilogram of dry solids, then repulped to 37% solids with process water prior to flotation. No collector or frother were used. Flotation concentrates were collected for the periods 0–3, 3–6, 6–10, 10–14 and 14–19 minutes. The flotation pH was about 9.3. For comparative purposes illustrative of standard practice without the use of amines the data in Table 5 is given. This may be compared with Table 6, in which 0.11 g/Kg (of dry solids) diethylene triamine (DETA) is added to the regrind. Addition of DETA in this amount results in massive depression of pyrrhotite (from 65.8% recovery in the standard test to 10.4% recovery in the test with DETA), although slight depression of Pn was observed.

TABLE 5

| | Px Rejection Feed, Standard Test | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.70 | 1.44 | 10.41 | 3.53 | 21.18 | 100.00 | 100.00 | 100.00 | 100.00 |
| Cumulative Concentrates | | | | | | | | | | |
| 0 min | 7.5 | 4.33 | 9.88 | 29.80 | 12.54 | 40.46 | 46.30 | 51.60 | 56.60 | 14.40 |
| 3 min | 12.8 | 3.91 | 7.31 | 30.13 | 11.32 | 48.73 | 71.20 | 65.10 | 69.80 | 29.50 |
| 6 min | 16.6 | 3.36 | 6.16 | 30.35 | 9.74 | 53.53 | 79.60 | 71.20 | 75.10 | 42.10 |
| 10 min | 19.7 | 2.97 | 5.49 | 30.55 | 8.62 | 56.67 | 83.20 | 75.00 | 78.00 | 52.70 |
| 14 min | 23.7 | 2.59 | 4.82 | 30.39 | 7.49 | 58.90 | 87.00 | 79.30 | 81.10 | 65.80 |
| Tails | 76.3 | 0.12 | 0.39 | 4.22 | 0.35 | 9.49 | 13.00 | 20.70 | 18.90 | 34.20 |

TABLE 6

| | Px Rejection Feed, 0.11 g/Kg Diethylene Triamine | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.68 | 1.40 | 10.47 | 3.42 | 21.48 | 100.00 | 100.00 | 100.00 | 100.00 |
| Cumulative Concentrates | | | | | | | | | | |
| 0 min | 6.0 | 7.47 | 10.20 | 25.00 | 27.90 | 19.31 | 66.40 | 43.90 | 49.30 | 5.40 |
| 3 min | 7.5 | 6.87 | 10.18 | 24.64 | 27.83 | 20.01 | 76.20 | 54.70 | 61.30 | 7.00 |
| 6 min | 8.6 | 6.35 | 9.74 | 23.88 | 26.60 | 20.48 | 80.70 | 59.90 | 67.10 | 8.20 |
| 10 min | 9.4 | 6.00 | 9.33 | 23.28 | 25.46 | 20.84 | 82.90 | 62.40 | 69.80 | 9.10 |
| 14 min | 10.5 | 5.54 | 8.70 | 22.35 | 23.69 | 21.24 | 85.50 | 64.90 | 72.50 | 10.40 |
| Tails | 89.5 | 0.11 | 0.55 | 9.08 | 1.05 | 21.51 | 14.50 | 35.10 | 27.50 | 89.60 |

EXAMPLE III

Pyrrhotite rejection feed was floated in an experiment identical to that of Example II, except that pentaethylene hexamine was used as the amine depressant in plate of DETA, at an addition rate of 0.45 g/Kg of dry solids. Table 7 illustrates the results obtained by flotation according to standard practice. The effects of adding pentaethylene hexamine are shown by the data of Table 8, in which the recovery of pentlandite is higher and the recovery of pyrrhotite much lower than that observed in the standard test.

TABLE 7

| | Px Rejection Feed, Standard Test | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.57 | 1.23 | 9.20 | 2.99 | 18.94 | 100.00 | 100.00 | 100.00 | 100.00 |
| Cumulative Concentrates | | | | | | | | | | |
| 0 min | 3.2 | 5.61 | 8.37 | 31.00 | 22.27 | 43.92 | 31.60 | 22.00 | 24.00 | 7.50 |
| 3 min | 7.8 | 4.48 | 5.95 | 29.07 | 15.46 | 47.88 | 60.90 | 37.70 | 40.20 | 19.70 |
| 6 min | 10.6 | 3.87 | 5.07 | 28.25 | 12.98 | 49.53 | 71.80 | 43.80 | 46.00 | 27.80 |
| 10 min | 15.6 | 2.92 | 4.32 | 29.06 | 10.76 | 55.91 | 79.30 | 54.80 | 56.00 | 46.00 |
| 14 min | 23.1 | 2.11 | 3.59 | 28.91 | 8.64 | 59.42 | 85.20 | 67.50 | 66.80 | 72.60 |
| Tails | 76.9 | 0.11 | 0.52 | 3.26 | 1.29 | 6.75 | 14.80 | 32.50 | 27.40 | |

TABLE 8

| | Px Rejection Feed, 0.45 g/Kg Pentaethylene Hexamine | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.60 | 1.27 | 9.27 | 3.09 | 18.97 | 100.00 | 100.00 | 100.00 | 100.00 |
| Cumulative Concentrates | | | | | | | | | | |
| 0 min | 3.0 | 5.44 | 5.25 | 17.90 | 14.17 | 18.64 | 27.20 | 12.40 | 13.70 | 2.90 |
| 3 min | 5.0 | 5.73 | 5.01 | 18.10 | 13.50 | 19.00 | 48.20 | 19.90 | 21.90 | 5.00 |
| 6 min | 6.3 | 5.62 | 4.67 | 17.64 | 12.56 | 18.92 | 59.30 | 23.30 | 25.60 | 6.30 |
| 10 min | 11.1 | 4.21 | 5.72 | 22.12 | 15.18 | 31.45 | 78.30 | 50.20 | 54.50 | 18.40 |
| 14 min | 14.7 | 3.43 | 5.66 | 22.34 | 14.95 | 34.16 | 84.30 | 65.60 | 70.90 | 26.40 |
| Tails | 85.3 | 0.11 | 0.51 | 7.02 | 1.05 | 16.36 | 15.70 | 34.40 | 29.10 | 73.60 |

EXAMPLE IV

A sample was obtained from a stockpile of ore from the Sudbury area. The stockpile originally consisted of a material similar to that described in Example I except that the ore has been allowed to lie dormant for over a month, and had undergone extensive oxidation. The sample was treated according to a procedure identical to that of Example I. The data presented in Table 9 illustrates the flotation performance of the oxidized ore, and can be compared to the data of Table 10, which illustrates the effect of adding 0.45 g/Kg diethylene triamine (DETA) to the grind. When DETA is added to the grind the recovery of the Px is lower at any given recovery of Pn than that which is observed under standard conditions without DETA.

TABLE 9

| | Oxidized Ore, Standard Test | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.46 | 1.13 | 13.73 | 2.45 | 31.02 | 100.00 | 100.00 | 100.00 | 100.00 |
| Cumulative Concentrates | | | | | | | | | | |
| 0 min | 2.3 | 5.31 | 4.73 | 35.40 | 11.70 | 64.87 | 25.90 | 9.50 | 10.80 | 4.70 |
| 3 min | 5.5 | 4.15 | 5.01 | 34.99 | 12.46 | 66.18 | 49.50 | 24.50 | 28.10 | 11.80 |
| 6 min | 9.0 | 3.33 | 5.19 | 35.07 | 12.89 | 68.02 | 64.70 | 41.30 | 47.30 | 19.70 |
| 10 min | 13.5 | 2.49 | 4.65 | 34.44 | 11.36 | 69.93 | 72.70 | 55.60 | 62.70 | 30.50 |
| 14 min | 21.1 | 1.74 | 3.64 | 33.78 | 8.48 | 72.66 | 79.60 | 67.90 | 73.10 | 49.50 |
| Tails | 78.9 | 0.12 | 0.46 | 8.36 | 0.84 | 19.87 | 20.40 | 32.10 | 26.90 | 50.50 |

TABLE 10

| | Oxidized Ore, 0.45 g/Kg Diethylene Triamine | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.46 | 1.15 | 14.57 | 2.47 | 33.11 | 100.00 | 100.00 | 100.00 | 100.00 |
| Cumulative Concentrates | | | | | | | | | | |
| 0 min | 2.3 | 5.19 | 6.01 | 34.40 | 15.37 | 59.48 | 25.80 | 11.80 | 14.10 | 4.10 |
| 3 min | 3.3 | 4.41 | 6.06 | 33.86 | 15.49 | 59.99 | 32.20 | 17.50 | 20.90 | 6.00 |
| 6 min | 4.7 | 4.23 | 6.92 | 33.55 | 17.95 | 57.56 | 43.40 | 28.10 | 34.00 | 8.10 |
| 10 min | 7.1 | 3.77 | 6.98 | 33.71 | 18.08 | 58.99 | 58.90 | 43.10 | 52.20 | 12.70 |
| 14 min | 10.9 | 2.87 | 5.67 | 33.01 | 14.35 | 62.77 | 68.80 | 53.70 | 63.50 | 20.70 |
| Tails | 89.1 | 0.16 | 0.60 | 12.30 | 1.01 | 29.46 | 31.20 | 46.30 | 36.50 | 79.30 |

EXAMPLE V

A sample of Sudbury area nickel ore suitable for rod mill feed and similar to that ore described in Example I was floated according to the procedure described in Example I, except that the addition of potassium amyl xanthate was cut back to 0.01 g/Kg, added to the grind, while 0.03 g/Kg of Cyanamid TM AERO TM 3477 dithiophosphate was used in flotation. Table 11 illustrates the flotation results obtained according to this practice, while the data of Table 12 shows the effect of adding diethylene triamine 0.23 g/Kg to the grinding stage. The addition of diethylene triamine results in lower recovery of Px at any given recovery of Pn, although Pn is quite strongly depressed.

TABLE 11

| | Sudbury Ore, Xanthate and Dithiophosphate as Collector | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.83 | 0.85 | 7.98 | 2.01 | 16.10 | 100.00 | 100.00 | 100.00 | 100.00 |
| Cumulative Concentrates | | | | | | | | | | |
| 0 min | 1.4 | 4.52 | 13.30 | 31.70 | 36.14 | 36.39 | 7.80 | 22.40 | 25.80 | 3.20 |
| 3 min | 4.1 | 9.07 | 7.76 | 32.55 | 20.66 | 40.41 | 44.80 | 37.50 | 42.40 | 10.30 |
| 6 min | 6.9 | 9.40 | 5.69 | 31.01 | 14.84 | 43.28 | 77.20 | 45.80 | 50.70 | 18.40 |
| 10 min | 8.9 | 8.21 | 4.91 | 31.10 | 12.61 | 45.98 | 87.10 | 51.00 | 55.60 | 25.30 |
| 14 min | 10.5 | 7.22 | 4.47 | 30.48 | 11.34 | 48.04 | 90.30 | 54.80 | 59.00 | 31.20 |
| Tails | 89.5 | 0.09 | 0.43 | 5.36 | 0.92 | 12.37 | 9.70 | 45.20 | 41.00 | 68.80 |

TABLE 12

| | Sudbury Ore, Xanthate and Dithiophosphate as Collector With 0.23 g/Kg Diethylene Triamine | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.93 | 0.83 | 8.03 | 1.95 | 16.00 | 100.00 | 100.00 | 100.00 | 100.00 |
| Cumulative Concentrates | | | | | | | | | | |
| 0 min | 1.6 | 16.10 | 8.88 | 29.70 | 24.40 | 12.22 | 26.90 | 16.70 | 19.50 | 1.20 |
| 3 min | 2.6 | 16.45 | 8.06 | 28.99 | 22.14 | 11.53 | 45.10 | 24.90 | 29.00 | 1.80 |
| 6 min | 3.3 | 15.75 | 7.39 | 27.71 | 20.28 | 11.70 | 55.50 | 29.30 | 34.20 | 2.40 |
| 10 min | 3.7 | 15.48 | 7.00 | 27.12 | 19.17 | 11.89 | 61.10 | 31.00 | 36.20 | 2.70 |
| 14 min | 4.0 | 15.20 | 6.62 | 26.46 | 18.13 | 11.86 | 65.10 | 31.90 | 37.10 | 3.00 |
| Tails | 96.0 | 0.34 | 0.59 | 7.26 | 1.28 | 16.18 | 34.90 | 68.10 | 62.90 | 97.00 |

EXAMPLE VI

A sample of Sudbury area nickel ore suitable for rod mill feed similar to that ore described in Example I was floated according to the procedure described in Example I, except that the addition of potassium amyl xanthate was cut back to 0.01 g/Kg, added to the grind, while 0.03 g/Kg of Cyanamid TM S5415 thionocarbamate was used in flotation. Table 13 illustrates the flotation results obtained according to this practice, while the data of Table 14 shows the effect of adding diethylene triamine 0.23 g/Kg of dry solids to the grinding stage. As seen in the test with dithiophosphate, the addition of diethylene triamine results in lower recovery of Px at any given recovery of Pn, although Pn is quite strongly depressed.

TABLE 13

| | Sudbury Ore, Xanthante and Thionocarbamate as Collector | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.00 | 0.89 | 0.87 | 7.98 | 2.05 | 15.90 | 100.00 | 100.00 | 100.00 | 100.00 |
| Cumulative Concentrates | | | | | | | | | | |
| 0 min | 1.4 | 4.09 | 11.00 | 30.40 | 29.67 | 39.85 | 6.60 | 18.20 | 20.70 | 3.60 |
| 3 min | 3.6 | 7.93 | 7.77 | 31.66 | 20.66 | 41.09 | 31.60 | 32.00 | 35.90 | 9.20 |
| 6 min | 6.2 | 9.24 | 5.91 | 31.97 | 15.46 | 43.08 | 64.30 | 42.50 | 46.90 | 16.90 |
| 10 min | 8.2 | 8.80 | 5.22 | 31.74 | 13.49 | 45.31 | 80.60 | 49.40 | 53.90 | 23.30 |
| 14 min | 10.2 | 7.50 | 4.86 | 31.37 | 12.41 | 48.62 | 85.90 | 57.50 | 62.00 | 31.30 |
| Tails | 89.8 | 0.14 | 0.41 | 5.31 | 0.87 | 12.16 | 14.10 | 42.50 | 38.00 | 68.70 |

TABLE 14

| | Sudbury Ore, Xanthate and Thionocarbamate as Collector With 0.23 g/Kg Diethylene Triamine | | | | | | | | | |
|---|---|---|---|---|---|---|---|---|---|---|
| | | Assay % | | | | | Distribution | | | |
| | Wt. % | Cu | Ni | S | Pn | Px | Cu | Ni | Pn | Px |
| Calc Head | 100.0 | 0.97 | 0.88 | 8.33 | 2.09 | 16.55 | 100.00 | 100.00 | 100.00 | 100.00 |
| Cumulative Concentrates | | | | | | | | | | |
| 0 min | 1.4 | 15.00 | 7.00 | 27.50 | 19.13 | 14.09 | 21.10 | 10.80 | 12.50 | 1.20 |
| 3 min | 2.4 | 15.69 | 6.58 | 26.85 | 18.02 | 11.68 | 38.70 | 17.90 | 20.80 | 1.70 |
| 6 min | 3.4 | 14.61 | 6.42 | 26.60 | 17.50 | 14.23 | 51.60 | 25.00 | 28.90 | 3.00 |
| 10 min | 4.0 | 13.82 | 6.01 | 25.23 | 16.38 | 13.79 | 56.30 | 26.90 | 31.10 | 3.30 |
| 14 min | 4.6 | 13.15 | 5.56 | 23.85 | 15.14 | 13.12 | 61.80 | 28.80 | 33.20 | 3.60 |
| Tails | 95.4 | 0.39 | 0.66 | 7.59 | 1.46 | 16.72 | 38.20 | 71.20 | 66.80 | 96.40 |

EXAMPLE VII

In U.S. Pat. No. 4,684,459 ('459 patent) it is disclosed that certain diamines have collector properties in the flotation of certain ores, particularly chalcopyrite pentlandite ores. Specifically, in Table I, col. 11 of the '459 patent it is disclosed that N,N-dibutyl-1,2-ethane diamine (NDBED):

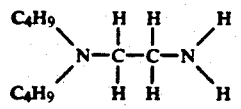

has collector properties as to a copper-nickel ore which are equivalent to those of sodium amyl xanthate an arch-typical collector. Data presented in this patent in terms of fractional recovery after 12 minutes (R-12) are set forth in Table 15.

TABLE 15

| | Cu | Ni | Gangue | Pyrrhotite |
|---|---|---|---|---|
| Na Amyl Xanthate | 0.939 | 0.842 | 0.039 | 0.333 |

TABLE 15-continued

| | Cu | Ni | Gangue | Pyrrhotite |
|---|---|---|---|---|
| NDBED | 0.926 | 0.849 | 0.042 | 0.473 |
| Na Amyl Xanthate + NDBED | 0.957 | 0.883 | 0.062 | 0.466 |

Table 15 shows that N,N dibutyl-1,2-ethane diamine collects rather than depresses pyrrhotite. As to pyrrhotite, it is disclosed to be a better collector than sodium amyl xanthate.

Contrary to the action of NDBED, the compounds employed in the process of the present invention exhibit essentially no collector characteristics especially in the presence of xanthate collector. Values comparative to those in Table 15 were obtained floating copper/nickel ore using potassium amyl xanthate, N-methyl ethylene diamine (NMED, the two materials together and, to establish a baseline for these tests a flotation using no reagent other than a frother. Contrary to what was said in the previous sentence, the numerical values taken from Table I of the '459 patent are not directly comparable to numerical values set forth in this Example. However, the trends of the numerical values can be compared.

Table 16 sets forth the amounts in g/Kg of ore of frother, xanthate and NMED in the tests made for this Example.

TABLE 16

| Test | Frother | KAX* | NMED** |
|---|---|---|---|
| A | 0.025 | — | — |
| B | 0.025 | 0.043 | — |
| C | 0.025 | 0.043 | 0.5 |
| D | 0.025 | — | 0.5 |

*KAX additions 0.01 g/Kg to grind, 0.033 g/Kg staged addition to flotation
**Thsi reagent was added to the grind Overall results in terms of cumulative fraction in concentrates of tests A through D are set forth in Table 17.

TABLE 17

| Test | Copper | Nickel | Rock | Pyrrhotite |
|---|---|---|---|---|
| A | 0.462 | 0.05 | 0.009 | 0.134 |
| B | 0.929 | 0.807 | 0.034 | 0.755 |
| C | 0.926 | 0.729 | 0.028 | 0.258 |
| D | 0.790 | 0.431 | 0.011 | 0.051 |

A comparison of data in Table 17 with date in Table 15 shows as a trend that recoveries of copper, nickel and pyrrohtite are significant and substantial in both tables. Use of a diamine alone as employed in the prior art (Table 15) results in recoveries of copper, nickel and pyrrhotite similar to those encountered with xanthate. When both were used together as reported in Table 15, recovery of all three copper, nickel and pyrrhotite were enhanced. In contrast when a compound within the restricted special group of compounds employed in the present invention is used alone, it exhibits nowhere near the collecting characteristics of a xanthate. When used together with a xanthate, the copper and nickel recoveries exhibited by xanthate alone are essentially maintained, but two thirds less pyrrhotite reports to the mineral concentrate. Thus by employing a restricted group of amine compounds in a flotation process, the present invention provides mineralogical and metallurgical flotation results not heretofore obtained and not taught by the relevant prior art.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features. It is to be noted that reference herein to "Inco practice" and the like refers to practices and the like employed at the facilities of Inco Limited in the Sudbury district of the Province of Ontario, Canada.

The embodiments of the invention in which an exclusive property or privilege is claimed are defined as follows:

1. A method of froth flotation of at least one floatable non-ferrous-metal-containing, sulfide mineral occurring with pyrrhotite comprising treating a ground mixture of said mineral with pyrrhotite to form a pulp in an aqueous alkaline continuum in the presence of a collector for said nonferrous metal containing sulfide mineral a frother and a gas phase distributed through said pulp and in the presence of an amount in excess of about 0.05 grams per kilogram of ground mineral mixture of at least one organic compound selected from the group consisting of diethylenetriamine, triethylenetetramine, tetraethylenepentamine, pentaethylenehexamine, 2-[(2aminoethyl)amino] ethanol, Tris-(2-aminoethyl)amine, N-methyl ethylenediamine and 1,2 diamino 2 methylpropane whereby said non-ferrous-metal-containing, sulfide mineral is floated to form a froth and said pyrrhotite is effectively depressed compared to results obtained using said collector, said frother and said gas phase in the absence of said organic compound.

2. A method as in claim 1 wherein said non-ferrous-metal-containing, sulfide mineral contains at least one metal from the group consisting of copper, nickel, lead and zinc.

3. A method as in claim 2 wherein said sulfide mineral is selected from the group consisting of chalcopyrite and pentalandite.

4. A method as in claim 3 wherein said sulfide mineral has undergone surface alteration due to exposure to oxidative conditions.

5. A method as in claim 1 wherein said aqueous alkaline continuum has a pH of about 8 to about 11.

6. A method as in claim 1 wherein said collector is a xanthate, dithiophosphate or thionocarbamate or a mixture thereof.

7. A method as in claim 1 wherein said gas phase is selected from the group consisting of air, nitrogen and nitrogen enriched air in bubble form.

8. A method as in claim 1 wherein said at least one non-ferrous-metal-containing, sulfide mineral is co-present in said pulp with particles of silicate minerals.

* * * * *